US006385825B1

(12) United States Patent
Wang et al.

(10) Patent No.: US 6,385,825 B1
(45) Date of Patent: May 14, 2002

(54) FEEDING DEVICE FOR PRENEEDLE PUNCHING OF NONWOVEN FABRICS

(75) Inventors: Shoci-Chyuan Wang, Taipei Hsien; Huang-Tang Hsu; Pyng-Nien Perng, both of Hsinchu, all of (TW)

(73) Assignees: Shoou Shyng Machinery Co., Ltd., Taipei Hsien; Industrial Technology Research Institute, Hsinshu, both of (TW)

( * ) Notice: Subject to any disclaimer, the term of this patent is extended or adjusted under 35 U.S.C. 154(b) by 0 days.

(21) Appl. No.: 09/903,545

(22) Filed: Jul. 13, 2001

(30) Foreign Application Priority Data

May 9, 2001 (TW) ..... 90111008

(51) Int. Cl.[7] ..... D04H 18/00
(52) U.S. Cl. ..... 28/107
(58) Field of Search ..... 28/107, 108, 109, 28/110, 111, 112, 113, 114, 115, 103, 104, 116, 122, 130; 26/18.6, 18.5

(56) References Cited

U.S. PATENT DOCUMENTS 2,142,728 A * 1/1939 Kienzle ..... 28/115
2,349,086 A * 5/1944 Foster ..... 28/115
3,097,413 A * 7/1963 Draper, Jr. ..... 28/110
3,166,823 A * 1/1965 Bernard ..... 28/110
3,287,786 A * 11/1966 Goy ..... 28/110
3,829,939 A * 8/1974 Dilo ..... 28/107
3,939,537 A * 2/1976 Kreeft et al. ..... 26/18.6
4,536,927 A * 8/1985 Feyerl et al. ..... 28/110
4,756,062 A * 7/1988 Kis ..... 28/110
5,031,289 A * 7/1991 LeRoy et al. ..... 28/107
5,349,728 A * 9/1994 Murakami et al. ..... 28/110
5,387,454 A * 2/1995 Werner ..... 28/109
5,671,518 A * 9/1997 Kummermehr et al. ..... 28/107
5,864,931 A * 2/1999 Best et al. ..... 28/110

* cited by examiner

*Primary Examiner*—Amy B. Vanatta
(74) *Attorney, Agent, or Firm*—Sughrue Mion, PLLC

(57) ABSTRACT

A feeding device for preneedle punching of nonwoven fabrics that includes a stripper plate, a bed plate, a linear belt conveyer and a plurality of needles. The linear belt conveyer passes through a space between the stripper plate and the bed plate and conveys fiber batt to the space. Then, the needles punch and tangle the fiber batt in the space.

14 Claims, 7 Drawing Sheets

FEEDING DEVICE FOR PRENEEDLE PUNCHING OF NONWOVEN FABRICS

BACKGROUND OF THE INVENTION

1. Field of the Invention

The present invention relates in general to a feeding device for the preneedle punching of nonwoven fabrics.

2. Description of the Related Art

FIG. 1 depicts a conventional feeding device for the preneedle punching of fiber batt, in which bulky fiber batt 1 is conveyed to a feed-in roller 3 by a belt conveyer 2, where the fiber batt 1 is compressed by the roller 3, conveyed to the location between a stripper plate 4 and a bed plate 5, where the fiber batt is punched and tangled by plural needles 7 of a needle board 6, and then fed out by feed-out rollers 8. The bulky fiber batt 1 is compressed by the feed-in roller 3, but expands after the feed-in roller 3, before the stripper plate 4 and the bed plate 5. The fiber batt expands to a hunched shape, with a part of fiber batt accumulated at the inlet of the tangling zone between the stripper plate and the bed plate. As a result, the nonwoven fabrics have fish-scale-shaped traces or even creases thereon. The quality of the produced nonwoven fabrics is poor. Furthermore, the feed-in roller 3 and the needles 6 are separated by a distance in which the fiber batt is easily deformed due to draft. To prevent the draft and deformation of the fiber batt, the linear speed of feed-out rollers 8 is necessarily set faster than that of the feed-in roller 3. Generally, the draft ratio of the feed-out rollers 8 to the feed-in roller 3 is 1.2–2. If the draft ratio is small, then the fiber batt tends to accumulate at the inlet of the tangling zone. If the draft ratio is large, then the fiber batt is too tensed and is still deformed due to draft so that the produced nonwoven fabrics are of poor quality. Furthermore, thick fiber batt tends to accumulate at the inlet of the tangling zone between the stripper plate and the bed plate. Therefore, the stripper plate and the bed plate of a conventional preneedle punching machine generally are separated by a large distance to receive thick fiber batt. However, such an arrangement causes a vertical vibration of the fiber batt in the tangling zone so that the structure of the produced nonwoven fabrics is deteriorated.

U.S. Pat. No. 5,031,289 discloses a feeding device for a preneedle punching machine which includes an upper belt conveyer and a lower belt conveyer. The front edges of the belt conveyers have triangular noses extending towards the space between the stripper plate and the bed plate. This arrangement reduces the distance in which the fiber batt is not secured. However, the draft and deformation of the fiber batt cannot be totally eliminated.

Japanese Patent No. 5-163659 discloses a method and device for producing soft and bulky nonwoven fabrics, in which the bed plate is discharged and a plane belt conveyer is used instead. In the patent, the needles cannot penetrate through the fiber batt. The fiber batt (especially the bottom fiber batt) is not tangled very well. The method and device provides light punches and is only suitable for producing soft and bulky nonwoven fabrics.

A cylinder type of preneedle punching machine is provided to improve the problems of draft and deformation of fiber batt, wherein the stripper plate and the bed plate are replaced with an upper cylinder and a lower cylinder. The upper and lower cylinders have holes thereon, and have needle mounts inside. This type of preneedle punching machine does avoid the draft and deformation of fiber batt. However, the density of the needles is not adjustable because the needles are necessarily arranged to pass through the holes of the cylinders. Therefore, fiber batt of low internal cohesion cannot be tangled very well by this type of preneedle punching machine. Besides, the needle board of the preneedle punching machine needs to move in a trochoidal path so that this type of preneedle punching machine is too complicated in structure. Furthermore, the meshes of the nonwoven fabrics are too large. The fine needle punching process cannot eliminate the punching traces.

Another type of preneedle punching machine is provided with a brush conveyer, also used for improving the problems of draft and deformation of fiber batt, wherein the above-mentioned bed plate is replaced with the brush conveyer. The use of brush conveyer does improve the problems of draft and deformation of fiber batt. However, the soft fiber batt supported by the brush conveyer tends to sway so that the uniformity of the fiber batt during the preneedle punching operation is poor. As a result, the quality of the nonwoven fabrics is poor. Furthermore, vertical fiber is brought to the brushes by the needles, held by the brushes and thus fails to be tangled together with previous fiber. The fiber batt cannot be effectively tangled. As well, an external force is needed to strip the tangled fiber batt from the brush conveyer. The external force can possibly cause the draft and deformation of nonwoven fabrics. Therefore, this type of machine generally applies to the velour needle punching process.

SUMMARY OF THE INVENTION

An object of the present invention is to provide a feeding device for preneedle punching of nonwoven fabrics that solves the above-mentioned problems.

The feeding device of the present invention includes a stripper plate, a bed plate, a linear belt conveyer and a plurality of needles. The linear belt conveyer passes through a space between the stripper plate and the bed plate and conveys fiber batt to the space. Then, the needles punch and tangle the fiber batt in the space.

In the present invention, the linear belt conveyer continuously and actively holds the fiber batt during the preneedle punching process so that the distance between the stripper plate and the bed plate is reduced by 50%. As a result, the damage to the fiber batt by the airflow from the rapid motion of the needle board, and the vibrations of the fiber batt in the tangling zone, are effectively avoided. Furthermore, the elongation of the fiber batt before the tangling operation is minimized, thereby promoting the quality of resultant nonwoven fabrics.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENT

[Embodiment One]

Figure 1:
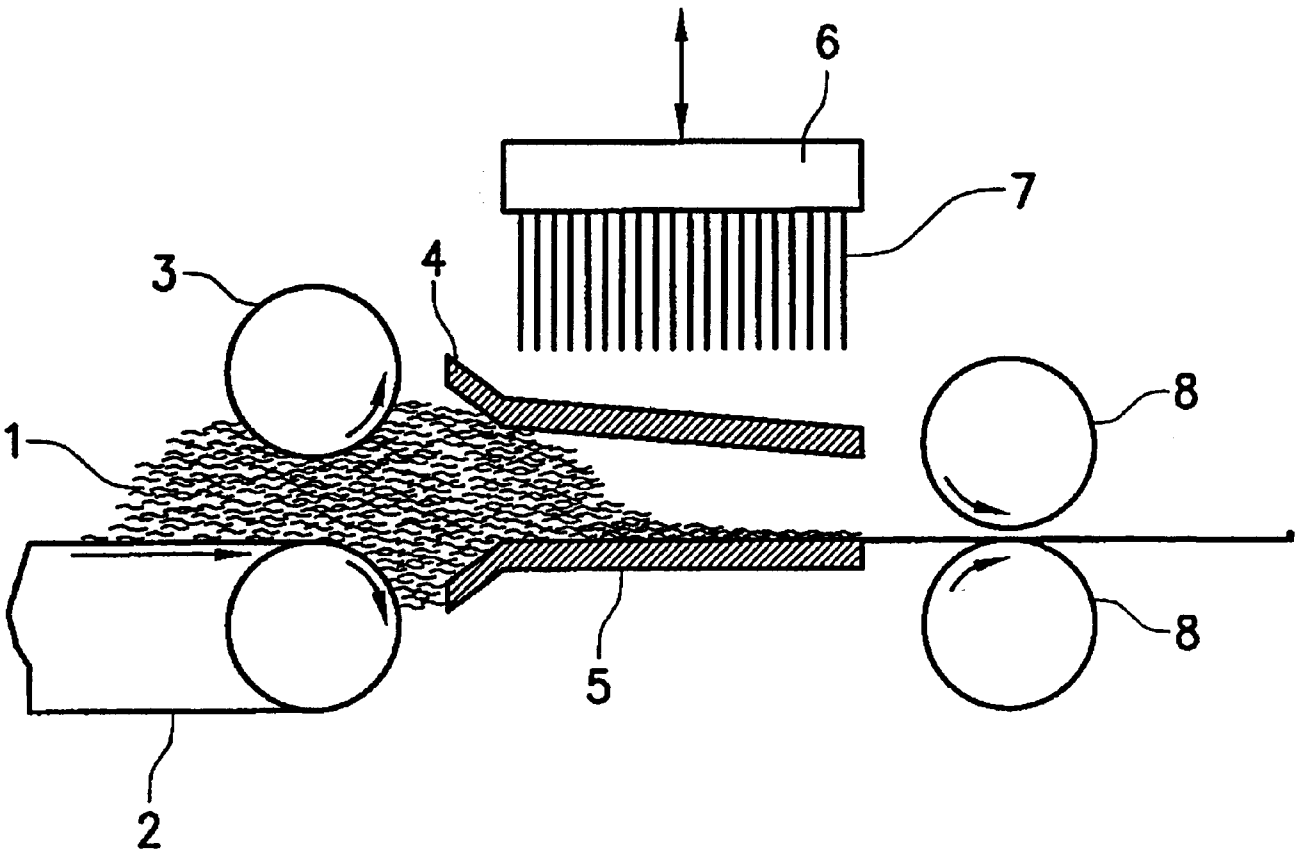
FIG. 1 (PRIOR ART)
FIG. 1 depicts a conventional feeding device for the preneedle punching of fiber batt.
Figure 2:
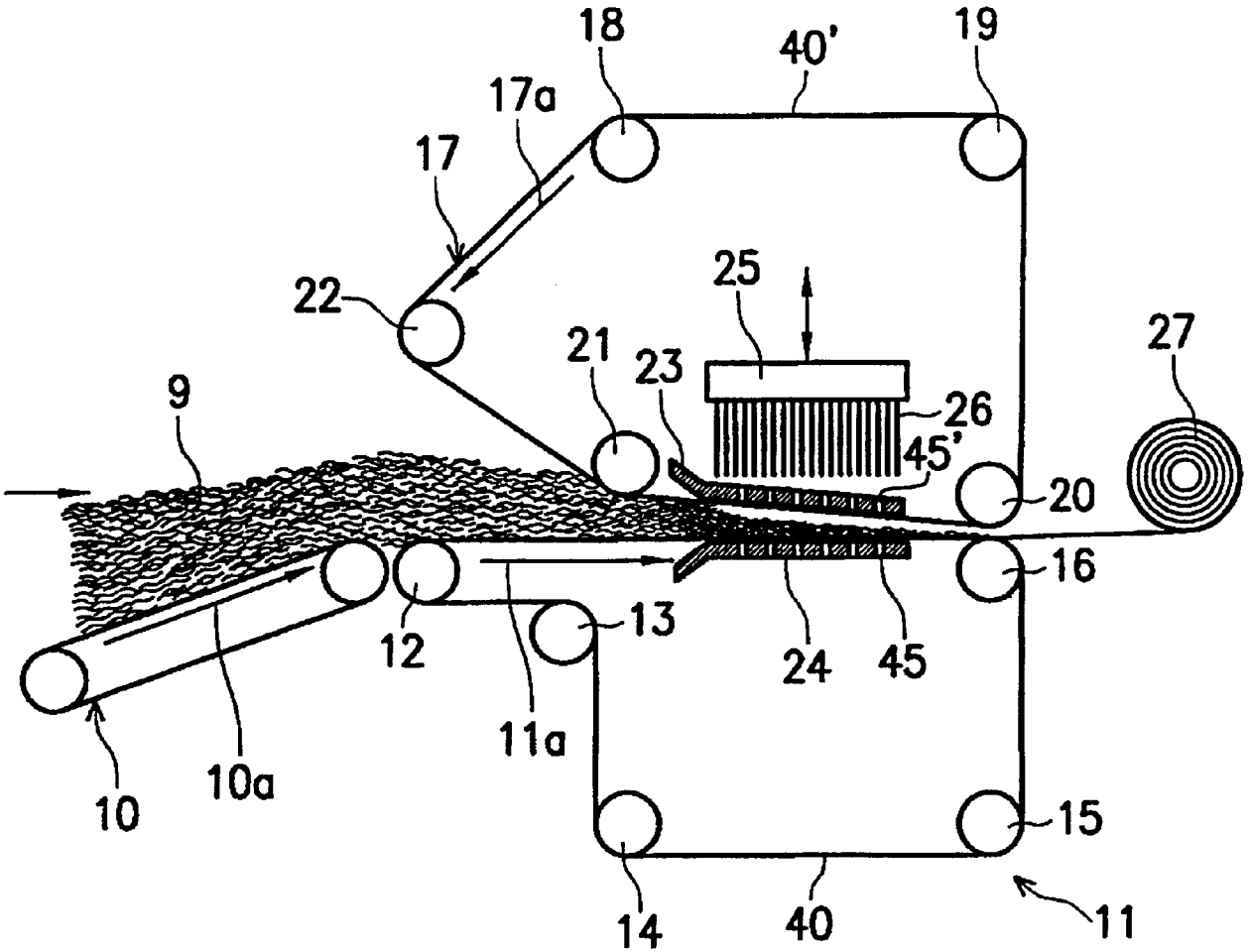
FIG. 2 depicts a feeding device for the preneedle punching of staple fiber in accordance with embodiment one of the present invention.

FIG. 2 depicts a feeding device for the preneedle punching of staple fiber in accordance with the present invention, wherein reference numeral 10*a* represents the conveying direction of a plane belt conveyer 10, reference numeral 11*a* the conveying direction of a lower linear belt conveyer 11, and reference numeral 17*a* the conveying direction of an upper linear belt conveyer 17. The upper linear belt conveyer 17 and the lower linear belt conveyer 11 have similar structures. The upper linear belt conveyer 17 includes a plurality of grooved rollers 18, 19, 20, 21, 22 and a plurality of linear elements 40' stretched over the rollers 18, 19, 20, 21, 22. Similarly, the lower linear belt conveyer 11 includes a plurality of grooved rollers 12, 13, 14, 15, 16 and a plurality of linear elements 40 stretched over the rollers 12, 13, 14, 15, 16.

Figure 3A:
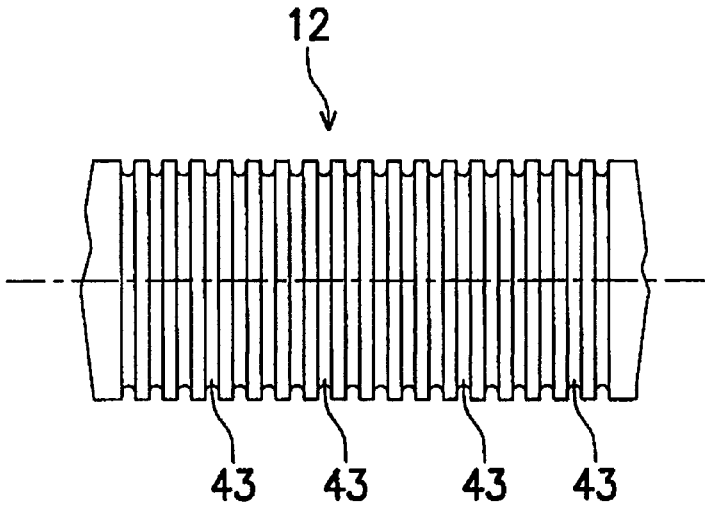
FIG. 3A is a top view of a grooved roller of the feeding device of FIG. 2.
Figure 3B:
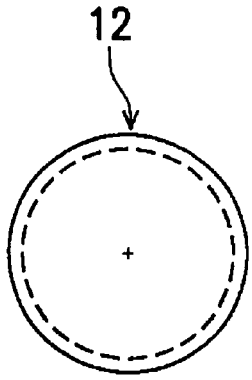
FIG. 3B is a right side view of the grooved roller of FIG. 3A.
Figure 4A:
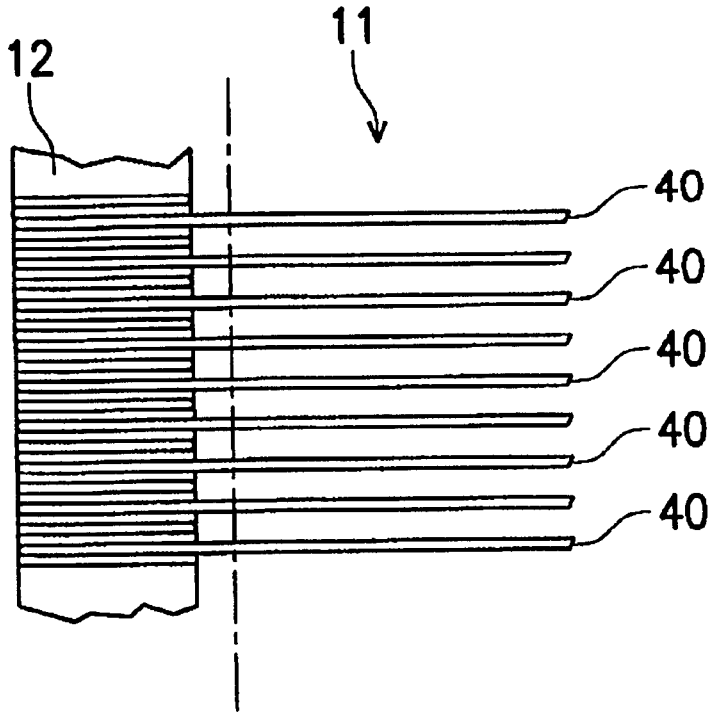
FIG. 4A is a top view of a grooved roller and a plurality of linear elements stretched over the grooved roller in accordance with embodiment one of the present invention.
Figure 4B:
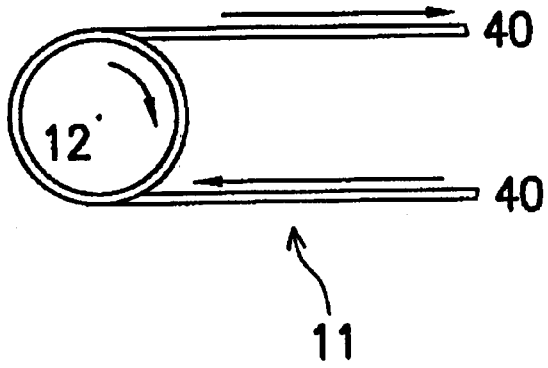
FIG. 4B is a side view of the grooved roller and linear elements of FIG. 4A.

For ease of description, only the detail of the lower linear belt conveyer 11 will be given. The shafts of the grooved rollers 12, 13, 14, 15, 16 are arranged in parallel to define the configuration of the lower linear belt conveyer 11. The rollers 12, 13, 14, 15, 16 of the lower linear belt conveyer 11 have the same structure. Referring to FIGS. 3A and 3B, the exemplary roller 12 is provided with a plurality of parallel grooves 43 on its surfaces. Also referring to FIGS. 4A and 4B, the linear elements 40 stretched over the rollers 12 (13, 14, 15, 16) are corase-denier monofilaments, multifilaments or ropes. At least one of the rollers 12, 13, 14, 15, 16 is movable to adjust tension in the linear elements 40.

Figure 5:
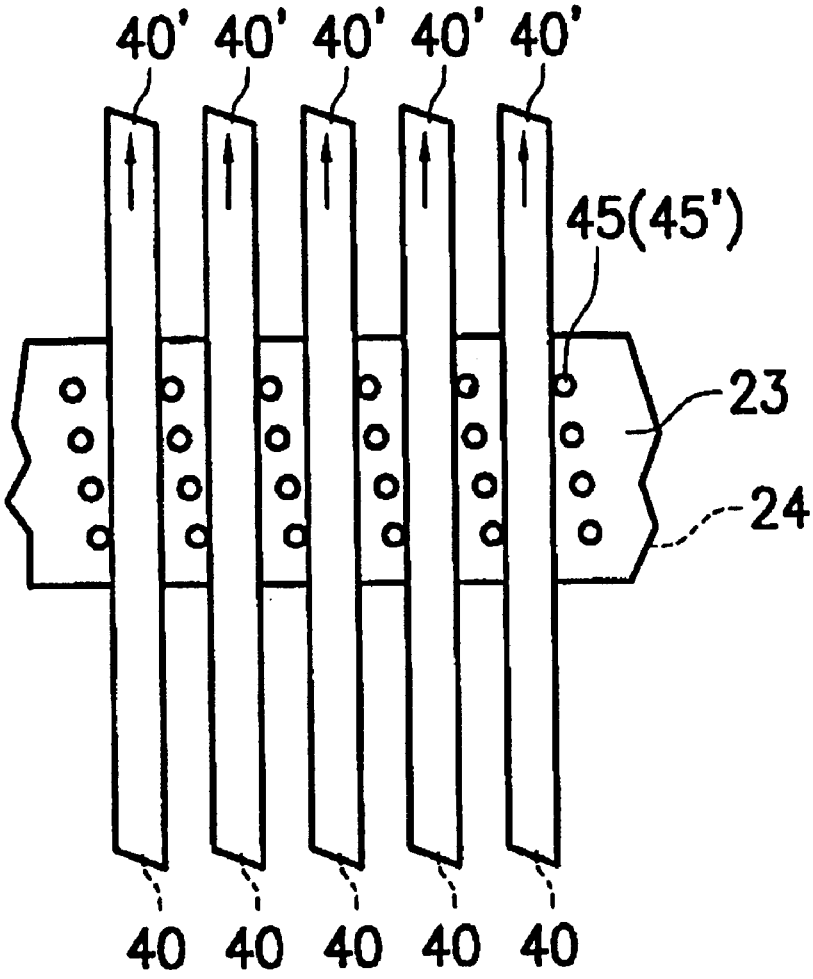
FIG. 5 is a top view of the stripper plate, the linear elements of the upper linear belt conveyer, the fiber batt, the linear elements of the lower linear belt conveyer and the bed plate of FIG. 2.

Referring back to FIG. 2, the lower linear belt conveyer 11 encloses a bed plate 24, with the inner surfaces of the linear elements 40 contacting the bed plate 24. The upper linear belt conveyer 17 encloses a stripper plate 23, with the inner surfaces of the linear elements 40' contacting the stripper plate 23. Staple fiber batt 9 is conveyed by the belt conveyer 10 to the location between the upper linear belt conveyer 17 and the lower linear belt conveyer 11 where the bulky fiber batt 9 is preliminarily compressed. Then, the fiber batt 9 is further conveyed to the location between the stripper plate 23 and the bed plate 24 where plural needles 26 of a needle board 25 are vertically moved in a reciprocating manner. The stripper plate 23 defines a plurality of holes 45' while the bed plate 24 defines a plurality of holes 45 aligned with the holes 45'. Further referring to FIG. 5, the holes 45, 45' are arranged in such a way that the needles 26 can pass between the linear elements 40 (40') to tangle the staple fiber batt into preneedled nonwoven fabrics 27 when the needles 26 pass through the holes 45, 45'. In the present invention, the belt conveyers 10, 11, 17*a* re driven by, for example, conventional motors (not shown). The upper linear belt conveyer 17 and the lower linear belt conveyer 11 provide the same linear conveying speeds.

Figure 6:
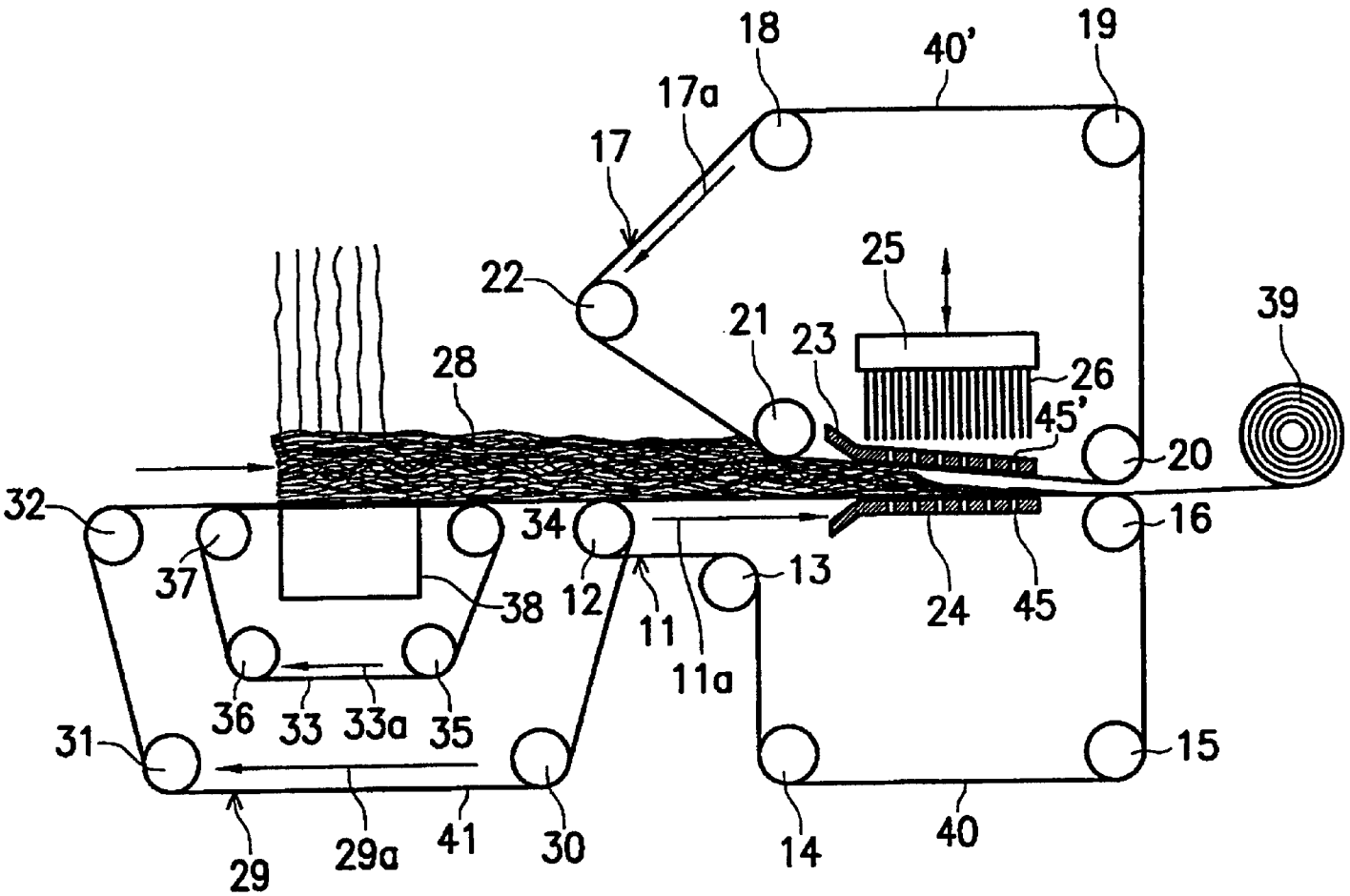
FIG. 6 depicts a feeding device for the preneedle punching of filament in accordance with embodiment two of the present invention.
Figure 7A:
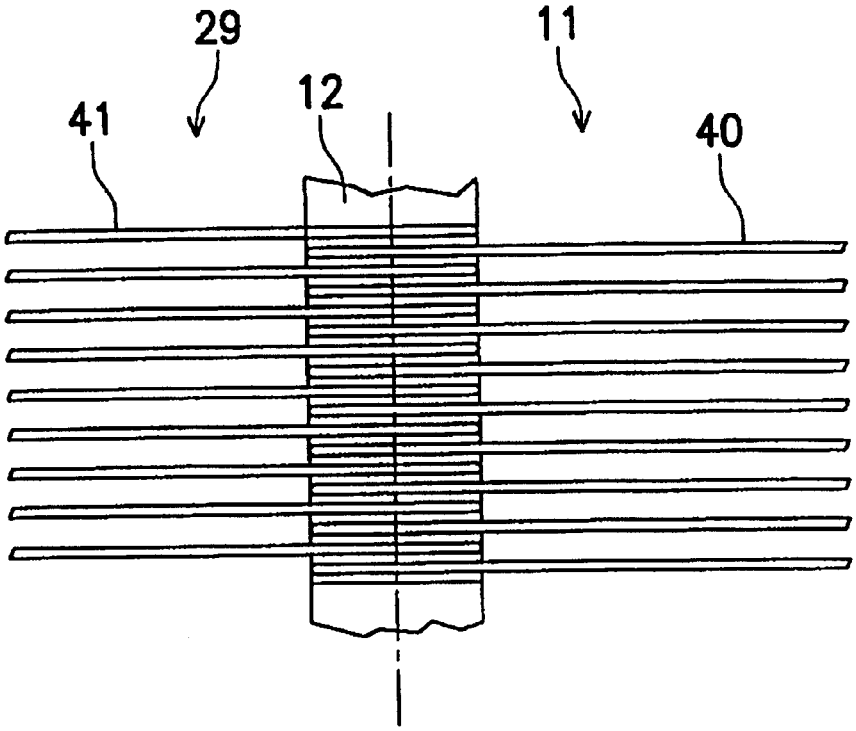
FIG. 7A is a top view of a grooved roller and a plurality of linear elements stretched over the grooved roller in accordance with embodiment two of the present invention.
Figure 7B:
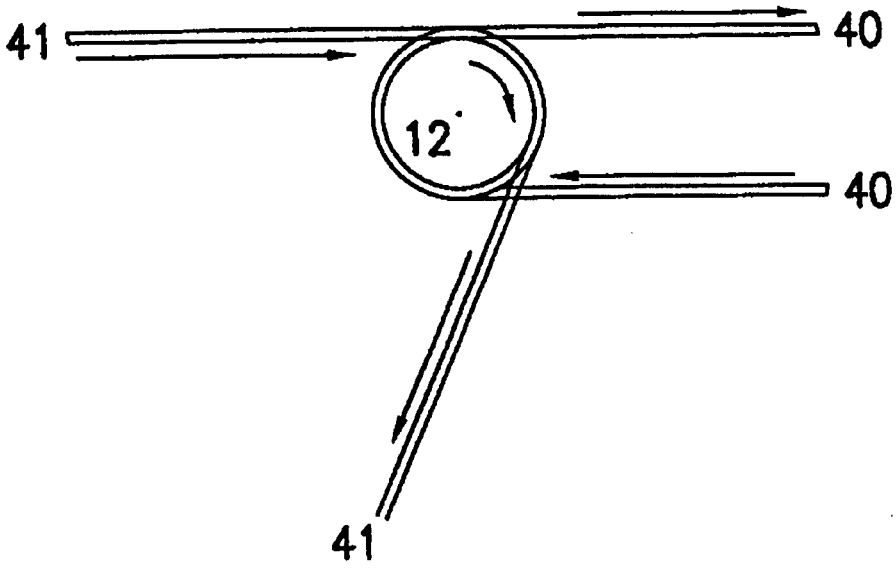
FIG. 7B is a side view of the grooved roller and linear elements of FIG. 7A.

FIG. 6 depicts a feeding device for the preneedle punching of filament in accordance with the present invention, wherein reference numeral 29 a represents the conveying direction of a linear belt conveyer 29, reference numeral 33 a the conveying direction of a meshy belt conveyer 33. The meshy belt conveyer 33 includes a plurality of flat rollers 34, 35, 36, 37 and a meshy belt 33 stretched over the flat rollers 34, 35, 36, 37. The linear belt conveyer 29 includes a plurality of grooved rollers 12, 30, 31, 32 and a plurality of linear elements 41 stretched over the grooved rollers 12, 30, 31, 32. It is noted that the linear elements 40 of the lower linear belt conveyer 11 and the linear elements 41 of the linear belt conveyer 29 are stretched over the same grooved roller 12, wherein the linear elements 40 and 41 are alternately arranged as shown in FIGS. 7A and 7B. The linear belt conveyer 29 encloses the meshy belt conveyer 33, wherein the inner surfaces of the linear belt conveyer 29 contacts the outer surfaces of the meshy belt conveyer 33. Furthermore, the meshy belt conveyer 33 encloses a vacuum intake device 38. The vacuum intake device 38 attracts continuous filament, which is changed to fiber batt 28 on the linear belt conveyer 29. The fiber batt 28 is conveyed by the linear belt conveyer 29 to the location between the upper linear belt conveyer 17 and the lower linear belt conveyer 11, and then fed to the location between the stripper plate 23 and the bed plate 24 where the needles 26 of the needle board 25 tangle the fiber batt into preneedled nonwoven fabrics 39. In this embodiment, the belt conveyers 11, 17, 29, 33 provide the same linear conveying speeds and are driven by, for example, conventional motors (not shown).

In the present invention, the linear belt conveyers continuously and actively hold the fiber batt during the preneedle punching process so that the distance between the stripper plate and the bed plate is reduced by 50%. As a result, the damage to the fiber batt by the airflow from the rapid motion of the needle board, and the vibrations of the fiber batt in the tangling zone are effectively avoided. Furthermore, the elongation of the fiber batt before the tangling operation is minimized, thereby promoting the quality of resultant nonwoven fabrics.

Furthermore, the linear belt conveyers continuously hold the fiber batt during the preneedle punching process so that the friction applied to the fiber batt by the stripper plate and the bed plate is small. Therefore, the elongation of the fiber batt in the present invention is smaller than that of the prior art. Furthermore, in the present invention, the feed-in speed and the feed-out speed for the fiber batt are equal. For the conventional feeding device, however, the draft ratio between the rollers needs to be additionally determined to maintain a flatness of the fiber batt between the feed-in roller and the feed-out roller. The present invention is superior to the prior art in this regard.

Furthermore, the present invention is suitable for continuous filament batt of low internal cohesion. In the present invention, the preneedle punching operation can smoothly proceed even without the use of binder or heat rollers. The problems of dropping, draft, deformation and accumulation of fiber batt do not occur.

Furthermore, in the present invention, the fiber batt is gradually compressed by the upper and lower linear belt conveyers before being tangled. This prevents the fiber batt from expanding to hunch shape and accumulating at the inlet of the tangling zone between the stripper plate and the bed plate, even if the fiber batt is heavy and bulky. In the present invention, the heavy and bulky fiber batt is smoothly fed into the tangling zone to be tangled.

This invention and the prior art are compared in the following table:

TABLE 1

| | Prior art | This invention |
|---|---|---|
| The manner of feeding fiber batt | Staged | continuous |
| Friction applied to the fiber batt by the stripper plate and the bed plate | Large | Small |
| The draft times of the fiber batt during the preneedle punching process | 1.2–2 | 1 (no draft) |
| Elongation rate of the fiber batt due to draft during the preneedle punching process | Large | Small |
| Distance between the stripper plate and the bed plate | Large | Small |
| Influence of airflow on the fiber batt, arising from the motion of the needle board | Serious | Light |
| Feeding status of continuous filament batt of low internal cohesion | Dropping, draft, deformation and accumulation | Smooth |
| Feeding status of heavy and bulky fiber batt | Shape-restoring, draft, deformation and accumulation | Smooth |

While the invention has been described by way of example and in terms of the preferred embodiment, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A feeding device including:

a stripper plate;

a bed plate;

a first linear belt conveyer passing through a space between the stripper plate and the bed plate and conveying fiber batt to the space;

a second linear belt conveyor passing through the space between the stripper plate and the bed plate, the fiber batt being contained between the first linear belt conveyor and the second linear belt conveyor; and a plurality of needles punching and tangling the fiber batt in the space.

2. A feeding device including:

a stripper plate;

a bed plate;

a first linear belt conveyer passing through a space between the stripper plate and the bed plate and conveying fiber batt to the space; and a plurality of needles punching and tangling the fiber batt in the space, wherein the first linear belt conveyer includes a plurality of first grooved rollers and a plurality of first linear elements stretched over the plurality of first grooved rollers.

3. A feeding device as claimed in claim 2, wherein the plurality of first linear elements are monofilaments.

4. A feeding device as claimed in claim 2, wherein the plurality of first linear elements are multifilaments.

5. A feeding device as claimed in claim 2, wherein the plurality of first linear elements are ropes.

6. A feeding device as claimed in claim 2, wherein the stripper plate and the bed plate define holes in such a manner that the plurality of needles can pass through the holes and pass between the plurality of first linear elements to tangle the fiber batt.

7. A feeding device as claimed in claim 2, wherein at least one first grooved roller is movable to adjust tension in the plurality of first linear elements.

8. A feeding device as claimed in claim 2, further including a second linear belt conveyer conveying the fiber batt to the first linear belt conveyer wherein the second linear belt conveyer includes a plurality of second linear elements stretched over one of the first grooved rollers.

9. A feeding device including:

a stripper plate;

a bed plate;

a first linear belt conveyer passing through a space between the stripper plate and the bed plate and conveying fiber batt to the space;

a plurality of needles punching and tangling the fiber batt in the space;

a meshy belt conveyer;

a second linear belt conveyer enclosing the meshy belt conveyer so as to convey the fiber batt to the first linear belt conveyer; and a vacuum intake device for sucking air to hold the fiber batt on the second linear belt conveyer.

10. A feeding device as claimed in claim 9, wherein the second linear belt conveyer includes a plurality of second grooved rollers and a plurality of second linear elements stretched over the plurality of second grooved rollers.

11. A feeding device as claimed in claim 10, wherein the plurality of second linear elements are monofilaments.

12. A feeding device as claimed in claim 10, wherein the plurality of second linear elements are multifilaments.

13. A feeding device as claimed in claim 10, wherein the plurality of second linear elements are ropes.

14. A feeding device as claimed in claim 10, wherein at least one second grooved roller is movable to adjust tension in the plurality of second linear elements.

* * * * *